US005169287A

United States Patent [19]

Proctor et al.

[11] Patent Number: 5,169,287

[45] Date of Patent: Dec. 8, 1992

[54] SHROUD COOLING ASSEMBLY FOR GAS TURBINE ENGINE

[75] Inventors: Robert Proctor, West Chester; Larry W. Plemmons, Fairfield; Gulcharan S. Brainch; John R. Hess, both of West Chester, all of Ohio; Robert J. Albers, Park Hills, Ky.

[73] Assignee: General Electric Company, Cincinnati, Ohio

[21] Appl. No.: 702,549

[22] Filed: May 20, 1991

[51] Int. Cl.[5] ..... F01D 5/18

[52] U.S. Cl. ..... 415/115; 415/116

[58] Field of Search ..... 415/115, 116, 173.1, 415/173.3, 174.2

[56] References Cited

U.S. PATENT DOCUMENTS

| | | | |
|---|---|---|---|
| 3,583,824 | 6/1971 | Smuland | 415/173.1 |
| 3,628,880 | 12/1971 | Smuland | 415/115 |
| 3,800,864 | 4/1974 | Hauser et al. | 165/47 |
| 3,844,343 | 10/1974 | Burggarf | 415/115 |
| 3,975,901 | 8/1976 | Hallinger et al. | 415/115 |
| 4,017,213 | 4/1977 | Przirembel | 416/97 |
| 4,222,707 | 9/1980 | Drouet et al. | 415/116 |
| 4,303,371 | 12/1981 | Eckert | 415/116 |
| 4,317,646 | 3/1982 | Steel et al. | 415/116 |
| 4,526,226 | 7/1985 | Hsia et al. | 165/109 |
| 4,551,064 | 11/1985 | Pask | 415/173.1 |
| 4,573,865 | 3/1986 | Hsia et al. | 415/115 |
| 4,693,667 | 9/1987 | Lenz et al. | 415/115 |
| 4,820,116 | 4/1989 | Hovan et al. | 415/115 |
| 5,039,562 | 8/1991 | Liang | 415/115 |
| 5,048,288 | 9/1991 | Bessette et al. | 415/116 |

*Primary Examiner*—John T. Kwon

*Attorney, Agent, or Firm*—Jerome C. Squillaro; John R. Rafter

[57] ABSTRACT

To cool the shroud in the high pressure turbine section of a gas turbine engine, high pressure cooling air is directed in metered flow to baffle plenums and thence through baffle perforations to impingement cool the shroud rails and back surface. Impingement cooling air then flows through elongated, convection cooling passages in the shroud and exits to flow along the shroud front surface with the main gas stream to provide film cooling. The baffle perforations and the convection cooling passages are interactively located to achieve maximum cooling benefit and highly efficient cooling air utilization.

14 Claims, 3 Drawing Sheets

SHROUD COOLING ASSEMBLY FOR GAS TURBINE ENGINE

The present invention relates to gas turbine engines and particularly to cooling the shroud surrounding the rotor in the high pressure turbine section of a gas turbine engine.

BACKGROUND OF THE INVENTION

To increase the efficiency of gas turbine engines, a known approach is to raise the turbine operating temperature. As operating temperatures are increased, the thermal limits of certain engine components may be exceeded, resulting in material failure or, at the very least, reduced service life. In addition, the increased thermal expansion and contraction of these components adversely effects clearances and their interfitting relationships with other components of different thermal coefficients of expansion. Consequently, these components must be cooled to avoid potentially damaging consequences at elevated operating temperatures. It is common practice then to extract from the main airstream a portion of the compressed air at the output of the compressor for cooling purposes. So as not to unduly compromise the gain in engine operating efficiency achieved through higher operating temperatures, the amount of extracted cooling air should be held to a small percentage of the total main airstream. This requires that the cooling air be utilized with utmost efficiency in maintaining the temperatures of these components within safe limits.

A particularly critical component subjected to extremely high temperatures is the shroud located immediately beyond the high pressure turbine nozzle from the combustor. The shroud closely surrounds the rotor of the high pressure turbine and thus defines the outer boundary of the extremely high temperature, energized gas stream flowing through the high pressure turbine. To prevent material failure and to maintain proper clearance with the rotor blades of the high pressure turbine, adequate shroud cooling is a critical concern.

One approach to shroud cooling, such as disclosed in commonly assigned U.S. Pat. Nos. 4,303,371—Eckert and 4,573,865—Hsia et al., is to provide various arrangements of baffles having perforations through which cooling air streams are directed against the back or radially outer surface of the shroud to achieve impingement cooling thereof. Impingement cooling, to be effective, requires a relatively large amount of cooling air, and thus engine efficiency is reduced proportionately.

Another approach is to direct a film of cooling air over the front or radially inner surface of the shroud to achieve film cooling thereof. Unfortunately, the cooling air film is continuously being swept away by the spinning rotor blades, thus diminishing film cooling effects on the shroud.

It is accordingly an object of the present invention to provide an improved cooling assembly for maintaining the shroud in the high pressure turbine section of a gas turbine engine within safe temperature limits.

A further object is to provide a shroud cooling assembly of the above-character, wherein effective shroud cooling is achieved using a lesser amount of pressurized cooling air.

An additional object is to provide a shroud cooling assembly of the above-character, wherein the same cooling air is applied in a succession of cooling modes to maximize shroud cooling efficiency.

Another object is to provide a shroud cooling assembly of the above-character, wherein heat conduction from the shroud into the supporting structure therefor is reduced.

Other objects of the invention will in part be obvious and in part appear hereinafter.

SUMMARY OF THE INVENTION

In accordance with the present invention, there is provided an assembly for cooling the shroud in the high pressure turbine section of a gas turbine engine which utilizes the same cooling air in a succession of three cooling modes, to wit, impingement cooling, convection cooling, and film cooling. In the impingement cooling mode, pressurized cooling air is introduced to baffle plenums through metering holes in a hanger supporting the shroud as an annular array of interfitting arcuate shroud sections closely surrounding a high pressure turbine rotor. Baffle plenums associated with the shroud sections are defined by a pan-shaped baffles affixed to the hanger, also in the form of an annular array of interfitted arcuate hanger sections. Each baffle is provided with a plurality of perforations through which streams of air are directed from a baffle plenum into impingement cooling contact with the back or radially outer surface of the associated shroud section.

To achieve convection mode cooling in accordance with the present invention, the shroud sections are provided with a plurality of straight through-passages extending in various directions which are skewed relative to the radial, axial and circumferential directions of the shroud pursuant to achieving optimum passage elongation. The baffle perforations are judiciously positioned such that the impingement cooling air streams contact the shroud back surface at locations that are intermediate the passage inlets, thus to optimize impingement cooling consistent with efficient utilization of cooling air. The impingement cooling air then flows through the passages to provide convection cooling of the shroud. These passages are concentrated in the forward portions of the shroud sections, which are subjected to the highest temperatures, and are relatively located to interactively increase their convective heat transfer characteristics.

The convection cooling air exiting the passages then flows along the radially inner surfaces of the shroud sections to afford film cooling.

The invention accordingly comprises the features of construction, combination of elements and arrangement of parts, all as set forth below, and the scope of the invention will be indicated in the claims.

For a full understanding of the nature and objects of the present invention, reference may be had to the following Detail Description taken in conjunction with the accompanying drawings, in which FIG. 1 is an axial sectional view of a shroud cooling assembly constructed in accordance with the present invention;

Corresponding reference numerals refer to like parts throughout the several views of the drawings.

DETAILED DESCRIPTION OF THE INVENTION

Figure 1:
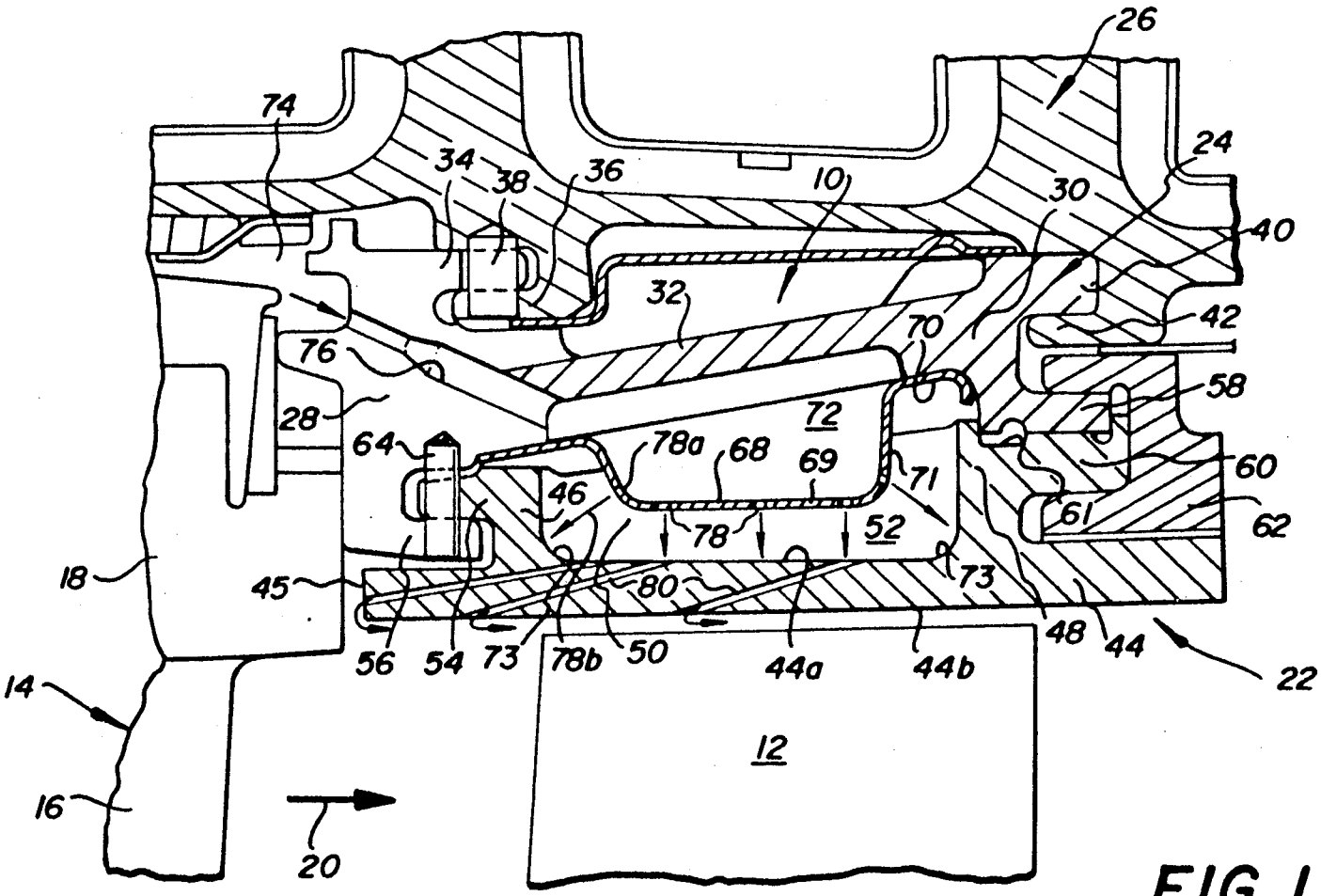

The shroud assembly of the present invention, generally indicated at 10 in FIG. 1, is disposed in closely surrounding relation with turbine blades 12 carried by the rotor (not shown) in the high pressure turbine section of a gas turbine engine. A turbine nozzle, generally indicated at 14, includes a plurality of vanes 16 affixed to an outer band 18 for directing the main or core engine gas stream, indicated by arrow 20, from the combustor (not shown) through the high pressure turbine section to drive the rotor in traditional fashion.

Shroud cooling assembly 10 includes a shroud in the form of an annular array of arcuate shroud sections, one generally indicated at 22, which are held in position by an annular array of arcuate hanger sections, one generally indicated at 24, and, in turn, are supported by the engine outer case, generally indicated at 26. More specifically, each hanger section includes a fore or upstream rail 28 and an aft or downstream rail 30 integrally interconnected by a body panel 32. The fore rail is provided with a rearwardly extending flange 34 which radially overlaps a forwardly extending flange 36 carried by the outer case. A pin 38, stacked to flange 36, is received in a notch in flange 34 to angularly locate the position of each hanger section. Similarly, the aft rail is provided with a rearwardly extending flange 40 in radially overlapping relation with a forwardly extending outer case flange 42 to the support of the hanger sections from the engine outer case.

Each shroud section 22 is provided with a base 44 having radially outerwardly extending fore and aft rails 46 and 48, respectively. These rails are joined by radially outwardly extending and angularly spaced side rails 50, best seen in FIG. 2, to provide a shroud section cavity 52. Shroud section fore rail 46 is provided with a forwardly extending flange 54 which overlaps a flange 56 rearwardly extending from hanger section fore rail 28 at a location radially inward from flange 34. A flange 58 extends rearwardly from hanger section aft rail 30 at a location radially inwardly from flange 40 and is held in lapping relation with an underlaying flange 60 rearwardly extending from shroud section aft rail 48 by an annular retaining ring 62 of C-shaped cross section. Pins 64, carried by the hanger sections, are received in notches 66 (FIG. 2) in the fore rail shroud section flanges 54 to locate the shroud section angular positions as supported by the hanger sections.

Pan-shaped baffles 68 are affixed at their brims 70 to the hanger sections 24 by suitable means, such as brazing, at angularly spaced positions such that a baffle is centrally disposed in each shroud section cavity 52. Each baffle thus defines with the hanger section to which it is affixed a baffle plenum 72. In practice, each hanger section may mount three shroud sections and a baffle section consisting of three circumferentially spaced baffles 68, one associated with each shroud section. Each baffle plenum 72 then serves a complement of three baffles and three shroud sections. High pressure cooling air extracted from the output of a compressor (not shown) immediately ahead of the combustor is routed to an annular plenum 74 from which cooling air is forced into each baffle plenum through metering holes 76 provided in the hanger section fore rails 28. It will be noted the metering holes convey cooling air directly from the nozzle plenum to the baffle plenums to minimize leakage losses. From the baffle plenums high pressure air is forced through perforations 78 in the baffles as cooling airstreams impinging on the back or radially outer surfaces **44*a* of the shroud section bases 44. The impingement cooling air then flows through a plurality of elongated passages 80 through the shroud sections bases to provide convection cooling of the shroud. Upon exiting these convection cooling passages, cooling air flows rearwardly with the main gas stream along the front or radially inner surfaces 44*b*** of the shroud sections to further provide film cooling of the shroud.

Figure 2:
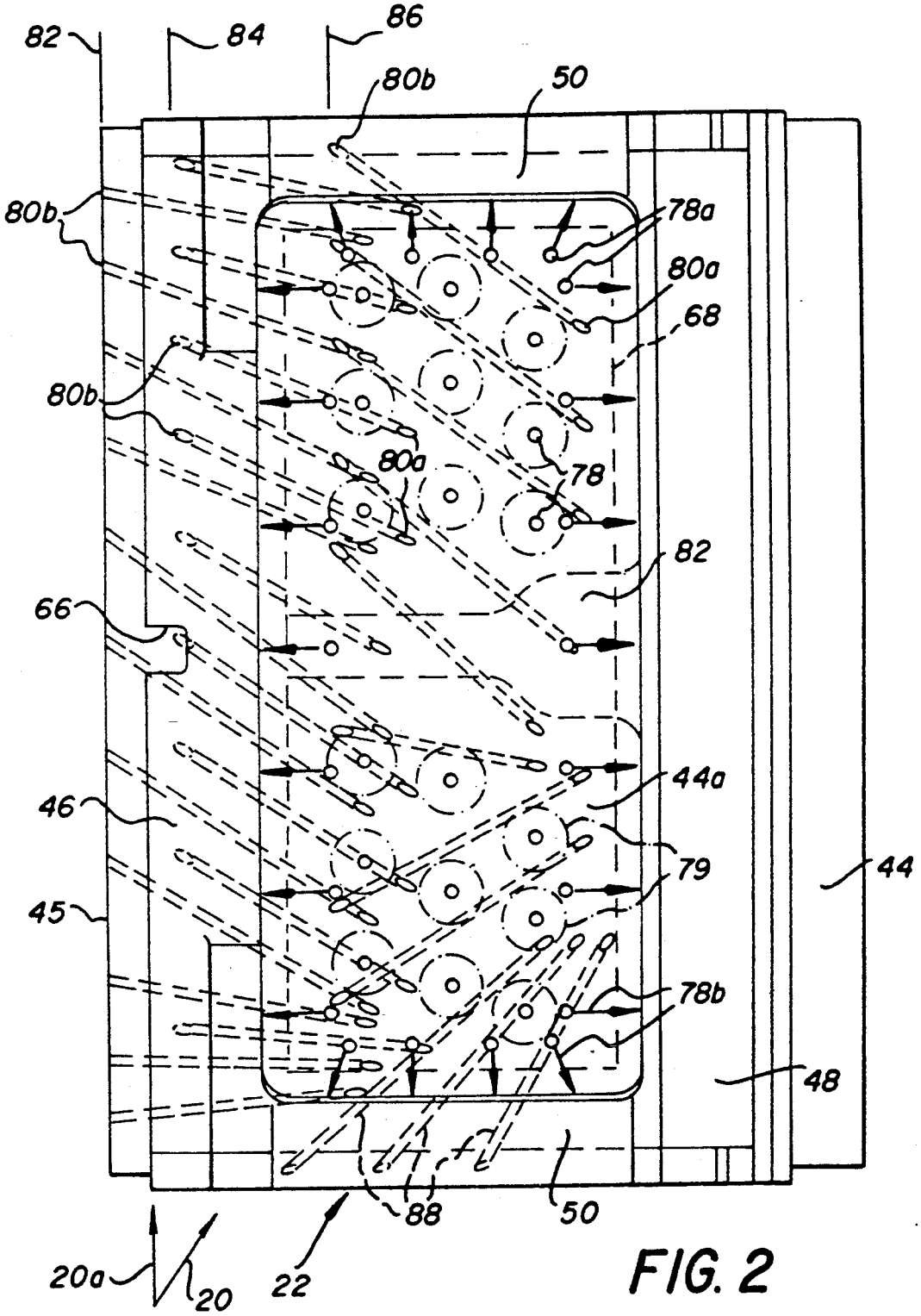
FIG. 2 is a plan view of a shroud section seen in FIG. 1 and illustrates the impingement and convection mode cooling patterns achieved by the present invention.

In accordance with the present invention, the baffle perforations 78 and the convection cooling passages 80 are provided in accordance with a predetermined location pattern illustrated in FIG. 2 so as to maximize the effects of the three cooling modes, i.e., impingement, convection and film cooling, while at the same time minimize the amount of compressor high pressure cooling air required to maintain shroud temperatures within tolerable limits. As seen in FIG. 2, the location pattern for perforations 78 in the bottom wall 69 of baffle 68 are in three rows of six perforations each. It is noted that a gap exists in the perforation row pattern at mid-length coinciding with a shallow reinforcing rib 82 extending radially outwardly from shroud section base 44. The cooling airstreams flowing through these bottom wall perforations impinge on shroud back surface **44*a* generally over impingement cooling areas represented by circles 79. As an important feature of the present invention, the bottom wall perforations are judiciously positioned such that the impingement cooled shroud surface areas (circles 79) avoid the inlets 80*a* of convection cooling passages 80**. Consequently, virtually no impingement cooling air from these streams flows directly into the convection cooling passages, and thus impingement cooling of the shroud is maximized.

In past shroud cooling designs, the location patterns for the baffle perforations and the convection cooling passages were established with regard to concentrating their separate cooling effects on the portion of the shroud experiencing the highest temperatures, i.e., the forward two-thirds of the shroud. Thus, there was no concern given to the locations of the baffle perforations and the convection cooling passages relative to each other, and, as a result, a certain amount of impingement cooling air flowed directly into the convection cooling passages. The contribution of this air to the impingement cooling of the shroud was therefore lost. More significantly, at those locations where the impingement cooled surface areas (circles 79) encompassed convection cooling passage inlets, the effects of impingement and convection cooling are compounded such as to cool these portions of the shroud to a greater extent than is necessary. Thus precious cooling air is wasted.

By virtue of the present invention, impingement and convection cooling are not needlessly duplicated to overcool any portions of the shroud, and highly efficient use of cooling air is thus achieved. Less high pressure cooling air is then required to hold the shroud temperature to safe limits, thus affording increased engine operating efficiency.

As seen in FIGS. 1 and 2, the baffle includes additional rows of perforations **78*a* in the sidewalls 71 adjacent bottom wall 69 to direct impingement cooling airstreams against the fillets 73 at the transitions between shroud section base 44 and the fore, aft and side rails, as indicated by arrows 78***b*. By impingement cooling the shroud at these uniformly distributed locations, heat conduction out through the shroud rails into the hanger and outer case is reduced. This heat conduction is further reduced by enlarging the normal machining relief in the radially outer surface of shroud flange 60, as indicated at 61, thus reducing the contact surface area between this flange and hanger flange 58. Limiting heat conduction out into the shroud hanger and outer case is an important factor in maintaining proper clearance between the shroud and the turbine blades 12.

Referring to FIG. 2, the location pattern for cooling passages 80 is generally in three rows, indicated by lines 82, 84 and 86 respectively aligned with the passage outlets 80*b*. It is seen that all of the passages 80 are straight, typically laser drilled, and extend in directions skewed relative to the engine axis, the circumferential direction and the radial direction. This skewing affords the passages greater lengths, significantly greater than the base thickness, and increases their convection cooling surfaces. The number of convection cooling passages can then be reduced substantially, as compared to prior designs. With fewer cooling passages, the amount of cooling air can be reduced.

The passages of row 82 are arranged such that their outlets are located in the radial forward end surface 45 of shroud section base 44. As seen in FIG. 1, air flowing through these passages, after having impingement cooled the shroud back surface, not only convection cools the most forward portion of the shroud, but impinges upon and cools the outer band 18 of high pressure nozzle 14. Having served these purposes, the cooling air mixes with the main gas stream and flows along the base front surface 44*b* to film cool the shroud. The passages of rows 84 and 86 extend through the shroud section bases 44 from back surface inlets 80*a* to front surface outlets 80*b* and convey impingement cooling air which then serves to convection cool the forward portion of the shroud. Upon exiting these passages, the cooling air mixes with the main gas stream and flows along the base front surface to film cool the shroud.

It will be noted from FIG. 2 that the majority of the cooling passages are skewed away from the direction of the main gas stream (arrow 20) imparted by the high pressure nozzle vanes 16 (FIG. 1). Consequently ingestion of the hot gases of this stream into the passages of rows 84 and 86 in counterflow to the cooling air is minimized. In addition, a set of three passages, indicated at 88, extend through one of the shroud section side rails 50 to direct impingement cooling air against the side rail of the adjacent shroud section. The convection cooling of one side rail and the impingement cooling of the other side rail of each shroud section beneficially serve to reduce heat conduction through the side rails into the hanger and engine outer case. In addition, these passages are skewed such that cooling air exiting therefrom flows in opposite to the circumferential component 20*a* of the main gas stream attempting to enter the gaps between shroud sections. This is effective in reducing the ingestion of hot gases into these gaps, and thus hot spots at these inter-shroud locations are avoided.

Figure 3:
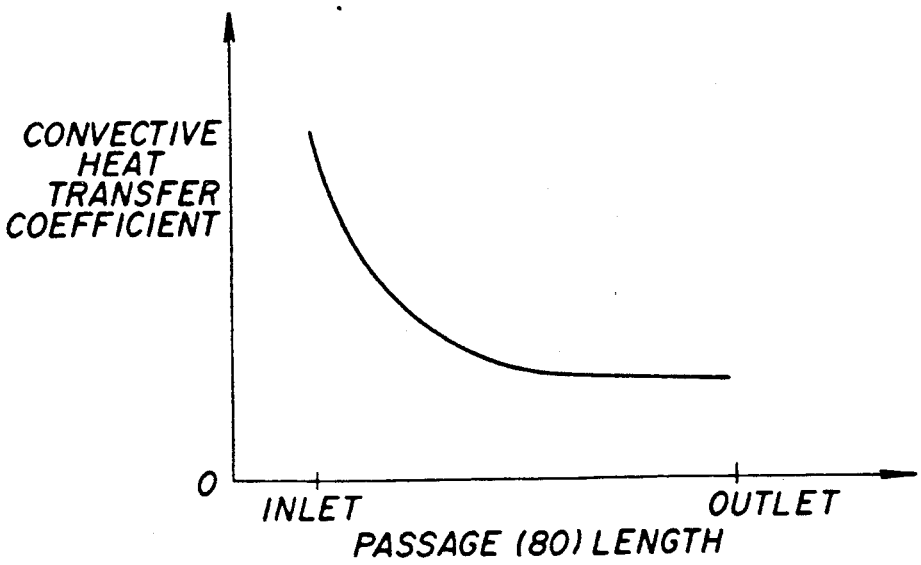
FIG. 3 is a graph illustrating the relationship of cooling passage length and convective heat transfer coefficient.
Figure 4:
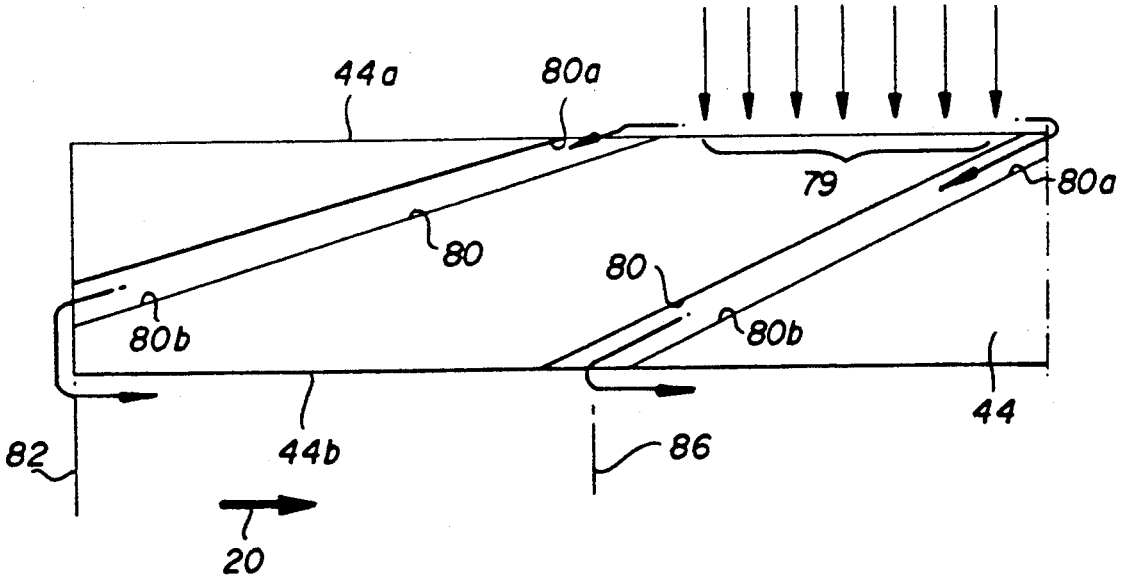
FIG. 4 is an idealized sectional view of a fragmentary portion of a shroud section, which diagrammatically illustrates the three modes of shroud cooling and the beneficial interactions thereof achieved by virtue of the present invention.

FIGS. 3 and 4 illustrate an additional feature of the present invention for improving shroud cooling efficiency. As seen in FIG. 3, the convective heat transfer coefficient of the cooling passages decreases significantly along their lengths from inlet to outlet. A major factor in this decrease is the buildup of a boundary layer of relatively stagnant air along the passage surface going from inlet to outlet. This boundary layer acts as a thermal barrier which decreases the convective transfer of heat from the shroud as boundary layer thickness increases. To compensate for this phenomenon in accordance with the present invention, the inlets 80*a* of the row 82 passages are substantially radially aligned with the outlets of the row 86 passages, as also seen in FIG. 2. Consequently, the maximum convective cooling adjacent the inlets of the row 82 passages compensates or interacts with the minimum convective cooling adjacent the outlets of the row 86 passages to provide adequate cooling of the intervening shroud material. FIG. 4 also illustrates that by limiting impingement cooling to areas of the shroud back surface intermediate the convection cooling passage inlets, but in many instances overlying a portion of the cooling passage length, compensation for the decrease in convective heat transfer coefficient is achieved to maintain the adjacent shroud material within temperature limits conducive to a long service life. In addition, since the maximum effectiveness of film cooling is adjacent the convection cooling passage outlets, further compensation is had for the minimum effectiveness of convection cooling also adjacent the passage outlets.

It will be noted from FIGS. 1 and 2 that the shroud section rails 46, 48 and 50 effectively frame those portions of the shroud sections immediately surrounding the turbine blades 12. As noted above, impingement cooling of these rails by the airstreams issuing from baffle perforations 78*a* reduces heat conduction out into the shroud support structure. These framed shroud portions, however, are afforded minimal film cooling since cooling air flowing along the inner shroud surfaces 44*b* is continuously being swept away by the turbine blades. It is seen from FIG. 2 that impingement cooling (circles 79) is concentrated on these framed shroud portions to compensate for the loss in film cooling. In addition, the inlets of the row 82 and row 84 passages are contiguously positioned at the hotter forward part of the framed shroud portions to take advantage of the maximum convection heat transfer characteristics thereat.

The portions of the shroud sections upstream from the turbine blades are effectively convection cooled by the cooling air flowing through the passages of rows 82 and 84 and film cooled by the cooling air exiting therefrom. It is seen that no cooling air is utilized to cool the shroud portions downstream from the turbine blades, as the temperature of the gas stream at this point has dropped dramatically due to expansion during flow through the high pressure turbine section. Also, film cooling at this location is extremely detrimental to engine performance, since it is essentially wasted.

From the foregoing Detailed Description, it is seen that the present invention provides a shroud cooling assembly wherein three modes of cooling are utilized to maximum thermal benefit individually and interactively to maintain shroud temperatures within safe limits. The interaction between cooling modes is controlled such that at critical locations where one cooling mode is of lessened effectiveness, another cooling mode is operating at near maximum effectiveness. Further, the cooling modes are coordinated such that redundant cooling of any portions of the shroud is avoided. Cooling air is thus utilized with utmost efficiency, enabling satisfactory shroud cooling to be achieved with less cooling air. Moreover, a predetermined degree of shroud cooling is directed to reducing heat conduction out into the shroud support structure to control thermal expansion thereof and, in turn, afford active control of the clearance between the shroud and the high pressure turbine blades.

It is seen from the foregoing, that the objectives of the present invention are effectively attained, and, since certain changes may be made in the construction set forth, it is intended that matters of detail be taken as illustrative and not in a limiting sense.

Having described the invention, what is claimed as new and desired to secure by Letters Patent is:

1. A shroud cooling assembly for a gas turbine engine comprising, in combination:

A. a plurality of arcuate shroud sections circumferentially arranged to surround the rotor blades of a high pressure turbine in the gas turbine engine, each said shroud section including 1) a base having a radially outer back surface, a radially inner front surface defining a portion of a radially outer boundary for the engine main gas stream flowing through the high pressure turbine, an upstream end and a downstream end, 2) a fore rail extending radially outwardly from said base adjacent said upstream end thereof, 3) an aft rail extending radially outwardly from said base adjacent said downstream end thereof, 4) a pair of spaced side rails extending radially outwardly from said base in conjoined relation with said fore and aft rails, and 5) a plurality of convection cooling passages extending through said base with inlets at said base back surface and outlets at said base front surface, said cooling passages having lengths greatly exceeding the thickness of said base between said back and front surfaces thereof, B. a plurality of arcuate hanger sections secured to the outer case of the gas turbine engine for supporting said shroud sections, each said hanger section including at least one hole therethrough for metering the flow of pressurized cooling air from a nozzle plenum, each said hanger section defining with said base back surface and said fore, aft and side rails of each said shroud section a shroud chamber;

C. a pan-shaped baffle affixed to each said hanger section in position in within each said shroud chamber to define with said hanger section a baffle plenum in communication with said metering hole to receive pressurized cooling air directly from said nozzle plenum, said baffle including a plurality of perforations through which streams of cooling air are radially inwardly directed into impingement with one of said shroud sections, the positions of said perforations being such that said cooling air streams impinge only on said base back surface at locations intermediate said convection cooling passage inlets, whereby to maximize impingement cooling of said shroud sections, the impingement cooing air then flowing through said passages to convection cool said shroud sections and ultimately flowing along said shroud front surface to provide film cooling of said shroud sections; and D. wherein said passages are interactively arranged in groups, said groups including first, second and third rows, such that said passage inlets of said first row are substantially radially aligned with said passage outlets of said second row, whereby to compensate for the characteristics of decreasing convection heat transfer coefficient as cooling air flows through said passages from said inlets to said outlets.

2. The shroud cooling assembly defined in claim 1, wherein said baffle includes an additional plurality of perforations positioned for directing streams of cooling into impingement cooling contact with said fore, aft and side rails at substantially uniformly distributed locations, whereby to reduce heat conduction from said shroud sections out into said hanger sections and said outer case.

3. The shroud cooling assembly defined in claim 2, wherein each said shroud section includes mounting flanges by which said shroud sections are supported from said hanger sections, at least one of said flanges having an extended machining relief to reduce surface area contact with the supporting one of said hanger sections and thus to reduce head conduction into said hanger sections, wherein said extended machining relief comprises an axially extending surface positioned radially inward of said hanger sections and between first and second fillet radii on said at least one of said flanges.

4. The shroud cooling assembly defined in claim 1, wherein said first row of said passages have inlets at said base back surface and outlets at a radial end surface at said upstream end of said base, whereby to direct impingement cooling air against an outer band of a turbine nozzle, said outer band impingement cooling air then flowing as film cooling air along said base front surface toward the turbine blades.

5. The shroud cooling assembly defined in claim 4, wherein said second row of said passages have inlets at said base back surface and outlets at said base front surface upstream from the turbine blades.

6. The shroud cooling assembly defined in claim 1, wherein each said shroud section includes a fourth row of passages having lets at said base back surface and extending through at least one of said side rails to project cooling air into the gaps between adjacent shroud sections in a direction to discourage ingestion of gases from the main gas stream in said gaps.

7. The shroud cooling assembly for a gas turbine engine comprising, in combination:

A. a plurality of arcuate shroud sections circumferentially arranged to surround the rotor blades of a high pressure turbine in the gas turbine engine, each said shroud section including 1) a base having a radially outer back shroud section including inner front surface defining a portion of a radially outer boundary for the engine main gas stream flowing through the high pressure turbine, an upstream end and a downstream end, 2) a fore rail extending radially outwardly from said base adjacent said upstream end thereof, 3) an aft rail extending radially outwardly from said base adjacent said downstream end thereof, 4) a pair of spaced side rails extending radially outwardly from said base in conjoined relation with said fore and aft rails, said fore, aft and side rails framing a portion of said base substantially radially aligned with the turbine blades, and 5) a plurality of convection cooling passages extending through said base, said cooling passages having lengths greatly exceeding the thickness of said base between said back and front surfaces thereof, B. a plurality of arcuate hanger sections secured to the outer case of the gas turbine engine for supporting said shroud sections, each said hanger section including at least one hole therethrough for metering the flow of pressurized cooling air from a nozzle plenum, each said hanger section defining with said base back surface and said fore, aft and side rails of each said shroud section a shroud chamber;

C. a pan-shaped baffle affixed to each said hanger section in position with each said shroud chamber to define with said hanger section a baffle plenum in communication with said metering hole to receive pressurized cooling air directly from said nozzle plenum, said baffle including a first plurality of perforations positioned to direct streams of cooling air into impingement with said fore, aft and side rails at substantially uniformly distributed locations and a second plurality of perforations through which streams of cooling air are directed into impingement with said back surface of said portion of said base framed by said rails to concentrate impingement shroud cooling thereat, the rail and base impingement cooling air then flowing through said passages to convection cool said shroud sections and ultimately flowing along said shroud radially inner surface to provide film cooling of said shroud sections:

D. wherein said passages have inlets at said back surface of said framed base portion, the positions of said plurality of perforations being such that the airstreams therefrom impinge only on said base back surface ate areas intermediate said passage inlets; and E. wherein said passages are interactively arranged in groups, said groups including first, second and third rows, such that said passage inlets of said first row are substantially radially aligned with said passage outlets of said second row, whereby to compensate for the characteristic of decreasing convection heat transfer coefficient as cooling air flows through said passages from said inlets to said outlets.

8. The shroud cooling assembly defined in claim 7, wherein each said shroud section includes a fourth row of passages having inlets at said base back surface and extending through at least one of said side rails to project cooling air into the gaps between adjacent shroud sections in a direction to discourage ingestion of gases from the main gas stream in said gaps.

9. The shroud cooling assembly defined in claim 7, wherein said first row of said passages have inlets at said base back surface and outlets at a radial end surface at said upstream end of said base, whereby to direct impingement cooling air against an outer band of a turbine nozzle, said outer band impingement cooling air then flowing as film cooling air along said base front surface toward the turbine blades.

10. The shroud cooling assembly defined in claim 9, wherein said second row of said passages have inlets at said base back surface and outlets at said base front surface upstream from the turbine blades.

11. The shroud cooling assembly defined in claim 10, wherein said third row of said passages have inlets at said base back surface and outlets at said base front surface.

12. The shroud cooling assembly defined in claim 11, wherein said first and second row passage inlets are concentrated at the forward part of said framed base portion to maximize cooling benefits where the shroud temperature is the highest.

13. The shroud cooling assembly defined in claim 12, wherein each said shroud section includes a fourth row of passages having inlets at said base back surface and extending through at least one of said side rails to project cooling air into the gaps between adjacent shroud sections in a direction to discourage ingestion of gases from the main gas stream in said gaps.

14. The shroud cooling assembly defined in claim 13, wherein each said shroud section includes mounting flanges by which said shroud sections are supported from said hanger sections, at least one of said flanges having an extended machining relief to reduce surface area contact with the supporting one of said hanger sections and thus to reduce heat conduction into said hanger section, wherein said extended machining relief comprises an axially extending surface positioned radially inward of said hanger sections and between first and second fillet radii on said at least one of said flanges.

* * * * *